United States Patent [19]

Mount

[11] 4,381,650

[45] May 3, 1983

[54] ELECTRONIC CONTROL SYSTEM FOR REGULATING STARTUP OPERATION OF A COMPRESSOR IN A REFRIGERATION SYSTEM

[75] Inventor: Gordon L. Mount, West Monroe, N.Y.

[73] Assignee: Carrier Corporation, Syracuse, N.Y.

[21] Appl. No.: 325,616

[22] Filed: Nov. 27, 1981

[51] Int. Cl.[3] ..... F25B 31/02

[52] U.S. Cl. ..... 62/157; 62/193; 62/228

[58] Field of Search ..... 62/217, 224, 225, 231, 62/469, 84, 192, 193, 228 D, 157, 228 C, 196 C; 417/13, 281, 902

[56] References Cited

U.S. PATENT DOCUMENTS

| | | | |
|---|---|---|---|
| 2,983,111 | 5/1961 | Miner et al. | 62/115 |
| 3,200,603 | 8/1965 | Wake et al. | 62/84 |
| 3,408,827 | 11/1968 | Soumeral et al. | 62/196 |
| 3,411,313 | 11/1968 | Brown et al. | 62/192 |
| 3,508,416 | 4/1970 | Miller | 62/84 |
| 3,873,239 | 3/1975 | Jamieson | 417/281 |
| 4,080,110 | 3/1978 | Szymaszek | 417/280 |
| 4,227,862 | 10/1980 | Andrew et al. | 417/13 |

*Primary Examiner*—Larry I. Schwartz

*Assistant Examiner*—Harry B. Tanner

*Attorney, Agent, or Firm*—Donald F. Daley; David L. Adour

[57] ABSTRACT

A method and control system for operating a vapor compression refrigeration system to prevent oil pump cavitation during startup of the refrigeration system is disclosed. The control system includes a temperature or pressure sensor located in the evaporator of the refrigeration system, a microprocessor, and an inlet guide vane control mechanism. During startup, the pressure of the gaseous refrigerant or the temperature of the liquid refrigerant in the evaporator of the refrigeration system, or compressor suction line pressure, is measured and an electrical signal corresponding to the measured pressure or temperature is processed by the microprocessor to determine the actual rate of pulldown of refrigerant pressure in the evaporator. The microprocessor compares the actual pulldown rate to a pulldown rate which has been predetermined to prevent compressor oil pump cavitation. The microprocessor controls the opening and closing of the inlet guide vanes to the compressor to adjust the flow of refrigerant to the compressor to achieve a pulldown rate which is approximately equal to the predetermined rate which prevents oil pump cavitation.

4 Claims, 2 Drawing Figures

ELECTRONIC CONTROL SYSTEM FOR REGULATING STARTUP OPERATION OF A COMPRESSOR IN A REFRIGERATION SYSTEM

BACKGROUND OF THE INVENTION

The present invention relates to vapor compression refrigeration systems, and more particularly relates to control systems and methods of operating such refrigeration systems to prevent oil pump cavitation during startup of the refrigeration systems.

Vapor compression refrigeration systems of the hermetic type have an oil lubricated compressor transmission and an oil reservoir which is usually located in a housing for the transmission. An oil pump, having an inlet in the oil reservoir, pumps oil from the reservoir to the compressor transmission and bearings. During normal operation of the compressor, gaseous refrigerant in the transmission housing contacts the oil in the reservoir. To reduce compressor motor windage losses the gaseous refrigerant is maintained at relatively low pressure, during operation of the refrigeration system, by connecting the transmission housing through a pressure equalization line to the suction side of the compressor. The low pressure also reduces the amount of refrigerant absorbed into the oil during operation of the refrigeration system. However, during shutdown of a refrigeration system, the pressure in the oil reservoir rises and an increased amount of refrigerant is absorbed into the oil in the oil reservoir. The amount of refrigerant absorbed is a function of the pressure of the gaseous refrigerant above the oil in the reservoir and the temperature of the oil in the oil reservoir.

The oil in the reservoir may be heated to reduce the amount of refrigerant dissolved into the oil during shutdown. However, substantial quantities of refrigerant may dissolve into the oil during shutdown even if the oil is heated. Then, upon startup of the refrigeration system the pressure in the transmission housing is reduced and refrigerant dissolved in the oil separates from the oil creating a boiling type action. The pressure decrease is due to connection of the suction of the compressor to the transmission housing through the pressure equalization line. The refrigerant boiling type action results in foaming of the oil and may result in the formation of vapor pockets at the inlet to the oil pump in the reservoir. This phenomenon is known as oil pump cavitation and is undesirable since it can prevent proper lubrication of the compressor transmission and bearings. Also, protective oil pressure sensing devices sense the pressure drop caused by the oil pump cavitation and may effect a shutdown of the refrigeration system.

Cycling timers which limit the rate of pulldown of refrigerant pressure in the evaporator of the refrigeration system during startup may be used to reduce oil pump cavitation. A fixed time period for controlling the position of inlet guide vanes to the compressor is set on the timer. The inlet guide vanes are controlled during the fixed time period to limit the rate of pressure drop in the evaporator and consequently reduce the boiling action of the gaseous refrigerant in the oil. Since the time period selected is fixed for all operating conditions, it is possible that oil pump cavitation may occur after the end of the fixed time period or that the rate of pulldown may be limited for a time period beyond the amount of time necessary to prevent oil pump cavitation.

Another device for reducing oil pump cavitation during startup is a differential oil pressure switch device. Usually, this type of device comprises two bellows, one of which is located in the oil circulation system, and the other of which is located at an inlet to the oil circulation system. When a pressure differential is detected indicating the occurrence of oil pump cavitation a control system responds to limit the rate of pulldown of refrigerant pressure in the evaporator of the refrigeration system. This type of differential oil pressure switch device is a relatively complex mechanical mechanism which is inherently subject to normal mechanical failure. Furthermore, this type of differential oil pressure switch device operates only after the onset of a cavitation condition and is not capable of preventing cavitation.

SUMMARY OF THE INVENTION

Therefore, an object of the present invention is to provide a reliable and efficient method and control system for operating a vapor compression refrigeration system during startup to prevent compressor lubrication pump cavitation.

Another object of the present invention is to provide a method and control system for operating a vapor compression refrigeration system to prevent compressor lubrication pump cavitation and to provide an optimal rate of pulldown of evaporator pressure during startup of the refrigeration system.

These and other objects of the present invention are attained by a control system for a vapor compression refrigeration system, comprising a temperature or pressure sensor located in the evaporator of the refrigeration system, or a pressure sensor in the compressor suction line, microprocessor control system, and an inlet guide vane control mechanism. The inlet guide vane control mechanism operates the compressor inlet guide vanes during startup in response to control signals from the microprocessor to adjust the volume flow rate of gaseous refrigerant from the evaporator to the compressor of the refrigeration system to prevent compressor lubrication pump cavitation.

In operation, during startup, the pressure of the gaseous refrigerant, or the temperature of the liquid refrigerant, in the evaporator of the refrigeration system is measured by a pressure sensor or a temperature probe, respectively. Alternatively, the pressure in the compressor suction line is monitored. The measured pressure or temperature is converted into an electrical signal for processing by the microprocessor control system. The microprocessor samples the measured pressure or temperature at startup and at selected times after startup. The microprocessor determines the actual rate of pulldown of refrigerant pressure in the evaporator from the time and pressure or time and temperature measurements. The microprocessor compares each actual pulldown rate to a pulldown rate which has been predetermined to prevent compressor lubrication pump cavitation. The microprocessor controls the opening and closing of the inlet guide vanes to the compressor to adjust the flow of refrigerant to the compressor to create a pulldown rate which is approximately equal to the predetermined rate which prevents oil pump cavitation.

BRIEF DESCRIPTION OF THE DRAWINGS

Further objects and advantages of the present invention will be apparent from the following detailed description in conjunction with the accompanying drawings, in which.

DESCRIPTION OF THE PREFERRED EMBODIMENT

Figure 1:
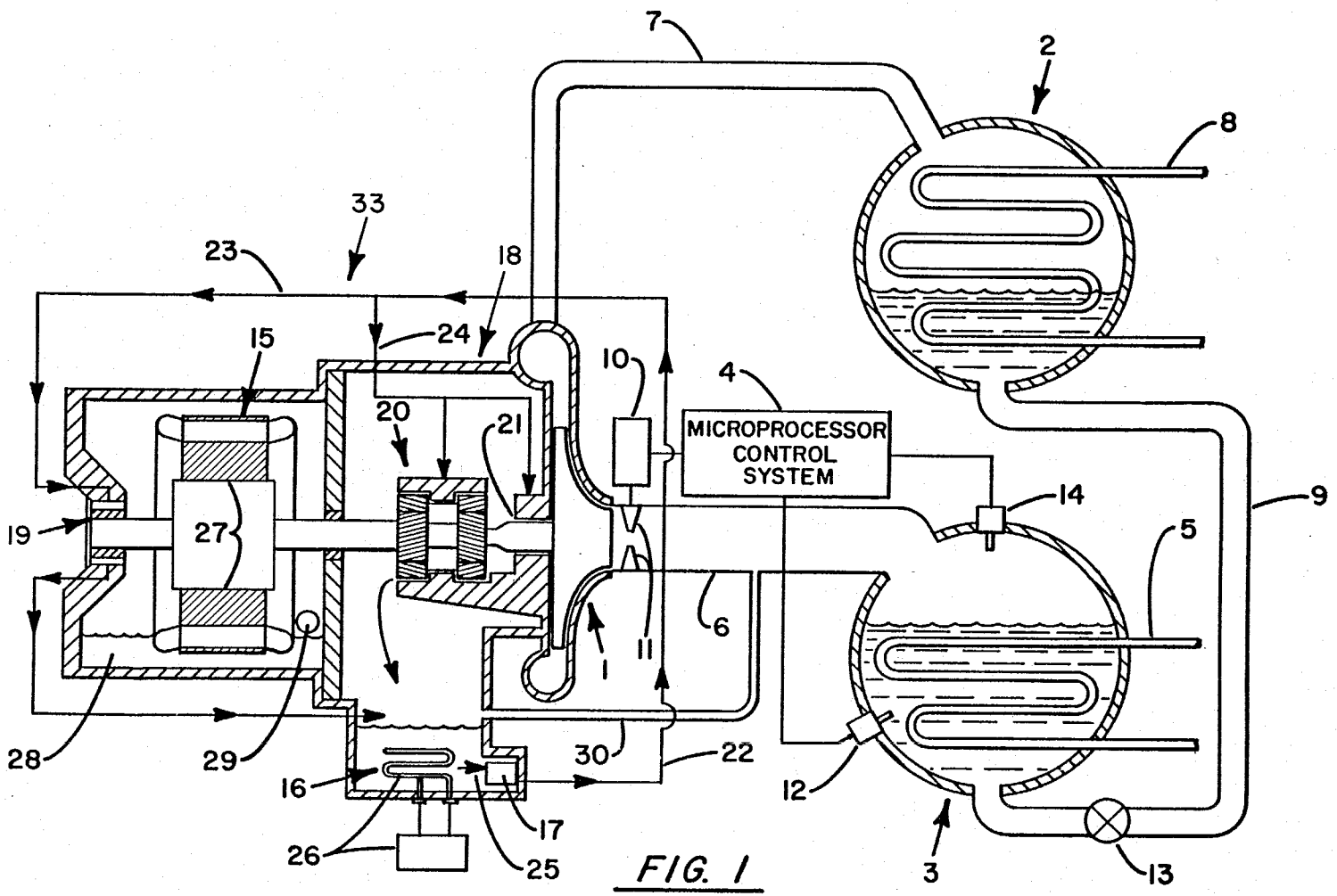
FIG. 1 is a schematic illustration of a vapor compression refrigeration system including a microprocessor control system capable of operating according to the principles of the present invention.

Referring to FIG. 1, a vapor compression refrigeration system is schematically illustrated which may be operated according to the principles of the present invention to prevent refrigeration compressor lubrication pump cavitation during startup of the refrigeration system. As shown in FIG. 1, the refrigeration system comprises a compressor 1, a condenser 2, and an evaporator 3. The condenser 2 and evaporator 3 are shell and tube type heat exchangers. In the evaporator 3, heat is transferred from a heat exchange medium, such as water, flowing through heat transfer tubing 5 to refrigerant in the evaporator 3 which is vaporized. The gaseous refrigerant from the evaporator 3 flows to the compressor 1 through a line 6. The compressor 1 has inlet guide vanes 11 which control the amount of refrigerant flow to the compressor 1. The gaseous refrigerant is compressed by the compressor 1 and passes through a line 7 to the condenser 2. In the condenser 2 heat is transferred from the refrigerant to a cooling medium flowing through tubing 8 thereby transforming the refrigerant to its liquid state. The liquid refrigerant from the condenser 2 passes to the evaporator 3 through line 9 and float valve 13 to complete the closed loop heat transfer cycle.

As illustrated in FIG. 1, a microprocessor control system 4 controls the operation of the refrigeration system. One function of the microprocessor 4 is to control the cooling capacity of the refrigeration system, in response to load conditions, by operating the inlet guide vane control mechanism 10 which opens and closes the inlet guide vanes 11 of the compressor 1. Normally, load conditions are determined by measuring the temperature of the heat exchange medium in the tubing 5.

However, for purposes of the present invention, in addition to load control temperature, the inputs to the microprocessor 4 include electrical signals indicating the pressure and/or temperature of the refrigerant in the evaporator 3. Alternatively, the suction pressure in the line 6 to the compressor may be monitored and corresponding electrical signals supplied to the microprocessor 4. As shown in FIG. 1, a temperature probe 12 and/or pressure sensor 14 located in the evaporator 3 may be used to provide an electrical signal to the microprocessor 4 indicating the temperature and/or pressure of the refrigerant in the evaporator 3. The temperature probe 12 may be a device such as a thermistor for monitoring the temperature of the liquid refrigerant in the evaporator 3. The pressure sensor 14 may be a device, such as a transducer strain gauge, for measuring the pressure of the gaseous refrigerant in the evaporator 3.

A motor 15 drives the compressor 1 through transmission 20 in housing 18. The compressor 1, the transmission 20 and motor 15 form an oil lubricated hermetic unit 33. The lubricating oil is pumped, by the operation of a pump 17, from an oil reservoir 16 located in the transmission housing 18 to the various components of the compressor 1, the transmission 20 and motor 15 which require lubrication. The oil reservoir 16 is vented to the suction side of the compressor 1 by a pressure equalization line 30. As shown in FIG. 1, motor end bearings 19, transmission 20, and journal bearings 21 of the hermetic unit 33 are oil lubricated. The lubricating oil enters oil lubrication circuits 22, 23, and 24 via an inlet 25 in the oil reservoir 16 and the oil from each lubrication circuit 22, 23 and 24 returns to the oil reservoir 16 by gravity feed.

Refrigerant from the refrigeration system is present within the transmission housing 18 due to gaseous refrigerant entering the housing 18 via pressure equalization line 30 from the suction side of the compressor 1. Motor cooling refrigerant enters the housing 18 through an inlet port (not shown) and, after passing through motor cooling passages 27, collects in a refrigerant reservoir 28. Refrigerant leaves the reservoir 28 via outlet port 29.

The pressure of the gaseous refrigerant above the oil reservoir 16 and the temperature of the oil in the oil reservoir 16 are the major factors determining the amount of refrigerant which is absorbed by the oil. The pressure of the gaseous refrigerant in the housing 18 depends on the pressure of the gaseous refrigerant on the suction side of the compressor 1. When the refrigeration system is operating, the compressor 1 reduces the pressure in suction line 6. This reduced pressure in line 6 produces a corresponding pressure reduction in transmission housing 18 and allows refrigerant to boil out of the oil in the oil reservoir 16. However, when the refrigeration system is not operating the pressure of the gaseous refrigerant above the oil reservoir 16 approaches ambient pressure thereby increasing the amount of refrigerant which is absorbed by the oil during shutdown. An oil heater 26 is provided to heat the oil in the oil reservoir 16 to prevent undesirable amounts of refrigerant from being absorbed into the oil during shutdown. However, substantial amounts of refrigerant may be absorbed by the oil even if the oil is heated.

When the refrigeration system is started, the guide vanes 11 in the compressor suction line 6 operate in response to the cooling requirements for the system and since cooling requirements are high at startup the guide vanes open and the pressure in the suction line 6 is reduced. The pressure of the gaseous refrigerant above the oil in the oil reservoir 16 is also reduced through line 30. This produces a boiling type action of the refrigerant in the oil in the oil reservoir 16. Vigorous boiling action produces foaming and vapor pockets in the oil reservoir 16 at the inlet 25 to the oil pump 17 thereby causing oil pump cavitation. These vapor pockets may momentarily result in a substantial reduction in oil pressure in the oil lubrication circuits 22, 23 and 24 which may prevent proper lubrication of the compressor. If there are protective systems monitoring the oil pressure in the lubrication circuits 22, 23 and 24, a decrease in lubricant pressure will cause these systems to respond to shut down the refrigeration system resulting in a recycling of the system which reduces overall operating efficiency.

By operating the refrigeration system according to the principles of the present invention, oil pump cavitation and the resulting recycling of the system is prevented. Specifically, the inlet guide vanes 11, which are controlled by the inlet guide vane control mechanism 10, may be opened, during startup, at a rate which is controlled by the microprocessor 4 to prevent oil pump cavitation rather than to meet load requirements. In effect, the normal operation of the refrigeration system is overridden, if necessary, during startup to prevent oil pump cavitation. It should be noted that controlling the rate of pulldown during startup, according to the principles of the present invention, has other advantages besides preventing oil pump cavitation and resulting refrigeration system shutdown and recycling. For example, energy savings may result because of a reduced peak power demand by the system at startup and because of efficiencies obtained by reducing part-load operating time.

For purposes of performing the override operation the microprocessor 4 continuously receives electrical signals during startup indicating the temperature or pressure of the refrigerant in the evaporator 3 from the temperature probe 12 or the pressure sensor 14. Alternatively, the pressure in the suction line 6 may be monitored. The microprocessor electronically determines the rate at which the refrigerant pressure in the evaporator 3 decreases, based on the pressure or temperature measurements as a function of time. This actual rate of pulldown of the pressure in the evaporator is electronically compared, by the microprocessor 4, to a rate which has been predetermined to provide a rate of pulldown of refrigerant pressure in the evaporator 3 which will prevent oil pump cavitation. The predetermined pulldown rate is programmed into the microprocessor 4 and the required comparison functions are built into the microprocessor 4 in the conventional manner. The control mechanism 10 is operated in response to an electrical output signal from the microprocessor 4 to control the closing and opening of the guide vanes 11 to achieve the predetermined pulldown rate.

One way of controlling the guide vanes 11 is to open the vanes in stages during startup rather than immediately fully opening the guide vanes 11 in response to the load requirements of the refrigeration system. According to this control scheme the vanes 11 are at a minimum opening size at startup and after a selected amount of time are opened slightly to a larger, first stage, opening size. The microprocessor 4 monitors the actual rate of pressure drop and compares it to the predetermined rate after the first stage of opening of the guide vanes 11. When the microprocessor determines that the actual pulldown rate is equal to or less than the predetermined rate the guide vanes are opened an additional amount to a second stage opening size. The microprocessor 4 continues to monitor the actual pulldown rate and compare it to the predetermined rate and repeats the previously described control function to open the guide vanes in further stages. In this manner, the inlet guide vanes 11 are opened to full capacity in the minimum time possible without excessive pressure drops.

After the startup period, the microprocessor 4 controls the guide vanes 11 totally in response to cooling load requirements of the refrigeration system. This is possible since enough refrigerant will have boiled out of the oil in the oil reservoir 16 during the startup period so that oil pump cavitation is no longer a problem. Of course, other methods of controlling the opening and closing of the guide vanes 11 are possible under the principles of the present invention. The critical factor is that the guide vanes 11 be controlled, during startup, to regulate the refrigerant pressure in the evaporator 3, and, therefore, also in the housing 18, to prevent cavitation problems.

The optimal refrigerant pressure pulldown rate is that rate which provides the fastest refrigeration system cooling capacity increase which may be maintained without causing a cavitation problem. This optimal pulldown rate is based on experience in operating a particular refrigeration system. The optimal rate varies depending on the amount of oil stored in the oil reservoir 16, the kind of refrigerant used in the refrigeration system, the temperature of the oil in the oil reservoir 16 at startup of the refrigeration system and other such factors.

Figure 2:
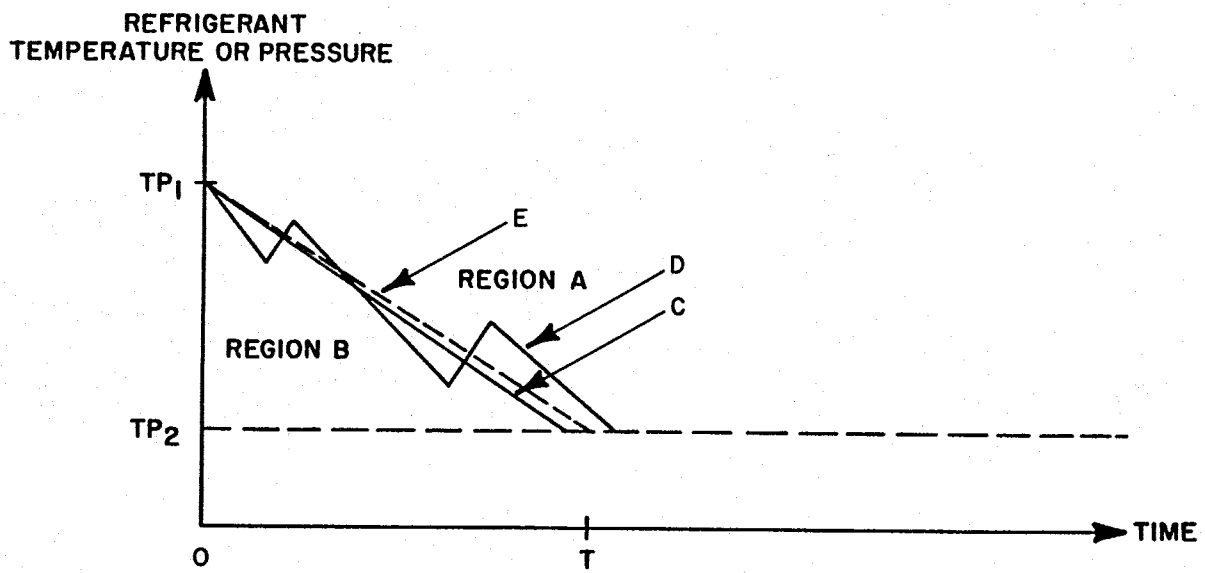
FIG. 2 is a graph of refrigerant pressure (or equivalently refrigerant temperature) in the evaporator of a refrigeration system as a function of time after startup of the refrigeration system. The curves shown in this Figure correspond to an optimal rate, a preferable rate, and a differential oil pressure system rate of evaporator refrigerant pressure pulldown for an ideal vapor compression refrigeration system such as depicted in FIG. 1.

Referring to FIG. 2, a solid straight-line curve C is shown which represents an idealized optimal pulldown rate for preventing oil pump cavitation during startup of the vapor compression refrigeration system depicted in FIG. 1. The curve C is a graphic representation of a predetermined pulldown rate which may be electronically preprogrammed into the microprocessor 4. This optimal pulldown rate is the fastest pulldown rate allowable which will still prevent an oil pump cavitation problem. As shown in FIG. 2, $TP_1$ represents the temperature or pressure of the refrigerant in the evaporator 3 at startup, which is designated as time zero. $TP_2$ represents the temperature or pressure of the refrigerant in the evaporator 3 at the end of the startup period when the pressure of the gaseous refrigerant in the housing 18 above the oil reservoir 16 has been reduced to a level whereby enough refrigerant has boiled out of the oil in the oil reservoir 16 so that oil pump cavitation is no longer a problem.

The magnitude of the optimal pulldown rate corresponds to the slope of the solid straight-line curve C shown in FIG. 2 and, since the curve shown is a straight line, this slope represents a fixed constant pulldown rate. The optimal pulldown rate may be a non-constant function of time and such a non-constant pulldown rate would be represented by a curve with a non-constant slope. Any straight-line curve which falls in region B, below the curve shown in FIG. 2, represents a pulldown rate at which oil pump cavitation may occur and represents a rate which is greater than the optimal rate represented by the curve C. The solid sawtooth curve D shown in FIG. 2 represents a pulldown rate which might be achieved with a differential oil pressure switch device of the type described previously in the "Background of the Invention" section. As shown in FIG. 2 this sawtooth curve C has straight-line sections falling below the optimal solid straight-line curve C thereby indicating that such a differential oil pressure switch device may allow cavitation to occur. Any straight line curve which falls in region A, above the curve C shown in FIG. 2, represents a pulldown rate which prevents oil pump cavitation but which is less than the optimal rate represented by the curve C.

It is most desirable to operate the refrigeration system so that the optimal rate of pulldown is achieved. However, in an actual operating environment it may be preferable to select a pulldown rate, for the predetermined rate, which is slightly less than the optimal rate to prevent oil pump cavitation from occurring even if uncontrollable variables cause the optimal rate to change from one startup to another. Such a preferable rate is shown by the dashed line curve E of FIG. 2.

Further referring to FIG. 2, time T represents the amount of time after startup to reach the $TP_2$ level from the $TP_1$ level when the preferable pulldown rate is maintained and, time T corresponds to the amount of time the primary chilled water temperature control function of the microprocessor 4 is overridden during startup to prevent oil pump cavitation. A fixed constant rate of pulldown, approximately equal to the optimal rate, usually is selected as the preferable pulldown rate which is progammed into the microprocessor 4 as the predetermined rate. A non-constant predetermined rate of pulldown as a function of time may be selected if the optimal rate is non-constant and it is desired to closely approximate this non-constant optimal rate.

Once a predetermined rate is selected the refrigeration system is operated during each startup to prevent oil pump cavitation as described previously. This result is efficiently achieved regardless of the startup refrigerant temperature or pressure $TP_1$ since during each startup the optimal pulldown rate is closely approximated according to the principles of the present invention. In effect, the amount of time T during which the load control function is overridden varies as a function of startup temperature or pressure. This type of operation minimizes the amount of time T during which the load control function of the microprocessor 4 is overridden during each startup. This is quite unlike the operation of a cycling timer which limits the rate of pulldown for the same fixed amount of time at each startup regardless of startup conditions.

Finally, while the present invention has been described in conjunction with particular embodiments it is to be understood that various modifications and other embodiments of the present invention may be made without departing from the scope of the invention as described herein and as claimed in the appended claims.

What is claimed is:

1. A control system for controlling flow of vaporous refrigerant from an evaporator to a compressor in a hermetically sealed refrigeration system during startup of the system comprising:

means for periodically measuring a refrigerant pressure or temperature at a location between the compressor and the evaporator during startup of the refrigeration system and for generating an electrical signal corresponding to the magnitude of each measured pressure or temperature;

electronic control means for receiving the electrical signals corresponding to the measured pressures or temperatures, for determining the actual refrigerant pressure pulldown rate from the received electrical signals, for comparing each actual pulldown rate to a predetermined pulldown rate and for generating a first electrical control signal when the difference between the predetermined pulldown rate and the actual pulldown rate is less than a first preselected limit and to generate a different, second electrical control signal when the difference between the predetermined pulldown rate and the actual pulldown rate is greater than a second preselected limit; and means for adjusting the capacity of the compressor in response to the electrical control signals from the electronic control means to adjust the actual pulldown rate to approximately equal the predetermined pulldown rate during startup of the refrigeration system.

2. A method of controlling flow of vaporous refrigerant from an evaporator to a compressor in a hermetically sealed refrigeration system during startup of the system, said method comprising the steps of:

measuring a refrigerant pressure or temperature corresponding to a gaseous refrigerant pressure at a location between the compressor and in the evaporator at the startup of the refrigeration system and at selected times thereafter;

generating electrical signals corresponding to the magnitude of each measured pressure;

electronically processing the electrical signals corresponding to the measured pressures to determine the actual rate of decrease in refrigerant pressure;

electronically comparing the rate of decrease of refrigerant pressure to a predetermined rate of decrease of pressure;

generating an electrical control signal when the difference between the predetermined rate and the actual rate is less than a first preselected limit and generating a second electrical control signal when the difference between the predetermined rate and the actual rate is greater than a second preselected limit; and adjusting the capacity of the compressor in response to the electrical control signals to adjust the actual rate to approximately equal the predetermined rate.

3. A method of controlling flow of vaporous refrigerant from an evaporator to a compressor in a hermetically sealed refrigeration system during startup of the system as recited in claim 2 wherein the step of adjusting the capacity of the compressor comprises:

increasing the flow rate of gaseous refrigerant from the evaporator to the compressor, each time a second electrical control signal is generated, by an amount selected to increase the actual pulldown rate to a level approximately equal to the predetermined rate, until a selected maximum volume flow rate is achieved.

4. In a refrigeration system having an evaporator, a condenser, a compressor, a hermetically sealed compressor transmission housing containing a lubricating oil reservoir and a lubricating oil pump the combination comprising:

a suction line connecting the compressor inlet to the evaporator to allow the flow of gaseous refrigerant from the evaporator to the compressor;

flow control means in the suction line to regulate the flow of gaseous refrigerant from the evaporator to the compressor;

a pressure equalization line connecting the suction line to the transmission housing to equalize the pressure in the housing with the pressure in the suction line;

means for determining the pressure in the evaporator and for generating electrical signals indicative of the pressure in the evaporator;

electronic control means for receiving the electrical signals indicative of the pressure in the evaporator and for comparing the electrical signals to a preprogrammed series of electrical signals which correspond to a predetermined rate of pressure decrease for the evaporator; and means for positioning the flow control means in response to signals from the electronic control means to regulate the pressure in the suction line and in the transmission housing.

* * * * *